United States Patent [19]

White

[11] 4,026,087

[45] May 31, 1977

[54] BUILDING BLOCK

[76] Inventor: Robert R. White, 2855 W. 22nd Ave., Vancouver, British Columbia, Canada, V6L 1M7

[22] Filed: Apr. 20, 1976

[21] Appl. No.: 678,462

[52] U.S. Cl. ..... 52/608; 52/594; 52/DIG. 10; 46/25

[51] Int. Cl.[2] ..... E04C 1/10

[58] Field of Search ..... 35/18 A, 72; 46/24, 46/25, 26; 52/DIG. 10; 229/22

[56] References Cited

UNITED STATES PATENTS

| | | | |
|---|---|---|---|
| 2,425,729 | 8/1947 | Sherbinin | 46/25 |
| 3,626,604 | 12/1971 | Pierce | 35/18 A |
| 3,666,607 | 5/1972 | Weissman | 52/DIG. 10 |
| 3,777,359 | 12/1973 | Bardot | 52/DIG. 10 |
| 3,782,029 | 1/1974 | Bardot | 35/72 |
| 3,974,611 | 8/1976 | Satterthwaite | 52/DIG. 10 |

*Primary Examiner*—John E. Murtagh
*Attorney, Agent, or Firm*—Fetherstonhaugh & Company

[57] ABSTRACT

Tetrahedron blocks are used to assemble structures of various shapes and sizes. The blocks have side walls joined along ridges which converge at four corners of the block. Each wall has an opening shaped to receive a corner of an adjoining block making up a structural unit.

5 Claims, 8 Drawing Figures

17
16
14
10
11
20
22
12
14
17
16
12
20
22
16
17

17
16
10
12
20
16
14
22
20
16
22
17
12
17
20
22

17
16
14
10
11
14
14
20
20
20
22
22
22
16
17
17
16

24
A
12
26
D
25
E
F
27
B
C 10
30
10
10
10
10

BUILDING BLOCK

My invention relates generally to building blocks and more particularly to blocks which provide a toy construction set.

A toy which has proven popular with children over the years is a set of cube-shaped blocks which can be arranged to form simplified structures such as walls, pyramids and so on. Such blocks serve well enough to entertain young children but there is a limit to what can be constructed using the blocks and, as a result, older children can easily become bored with the toy.

I overcome this disadvantage of conventional blocks by providing a toy with a far greater appeal to the imagination of older children. The present blocks can be connected together and stacked vertically as well as horizontally to construct a vast number of both regular and irregular shapes according to the whims of the child. The blocks primarily are intended for use as a toy but the invention also contemplates use of full-scale blocks of similar design in the construction of homes and the like.

More specifically, a device according to the present invention may be defined as a building block which comprises four identical walls each shaped as an equilateral triangle, said walls being bordered by ridges converging at corners of said block, each of the walls having an opening shaped to receive a corner of an adjoining block and form a joint therewith.

Figure 1:
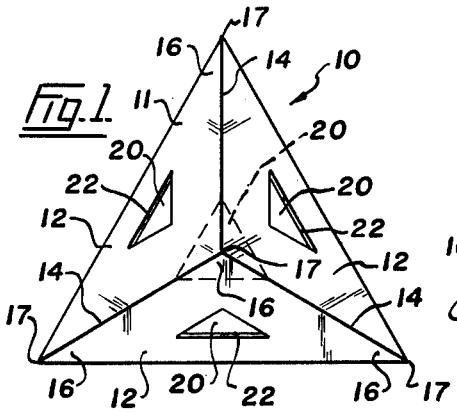
Figure 2:
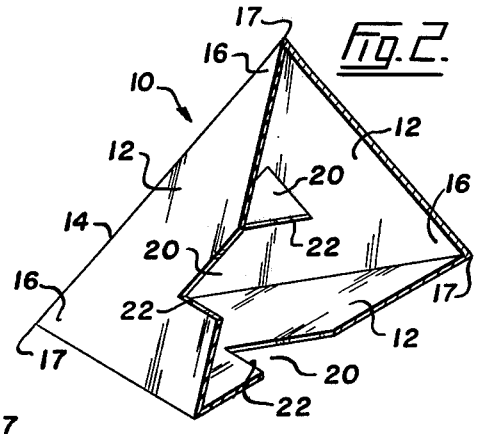
Figure 3:
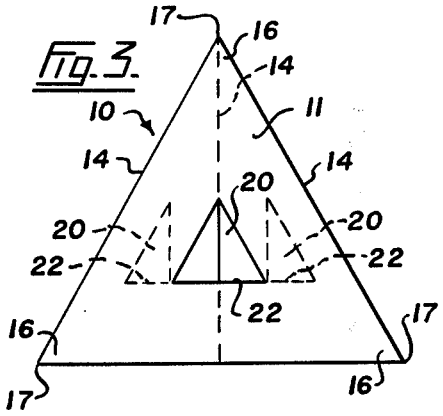
Figure 4:
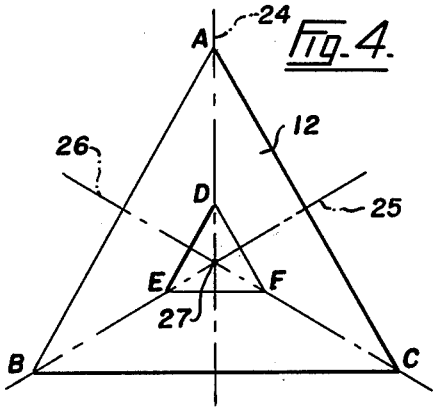
Figure 5:
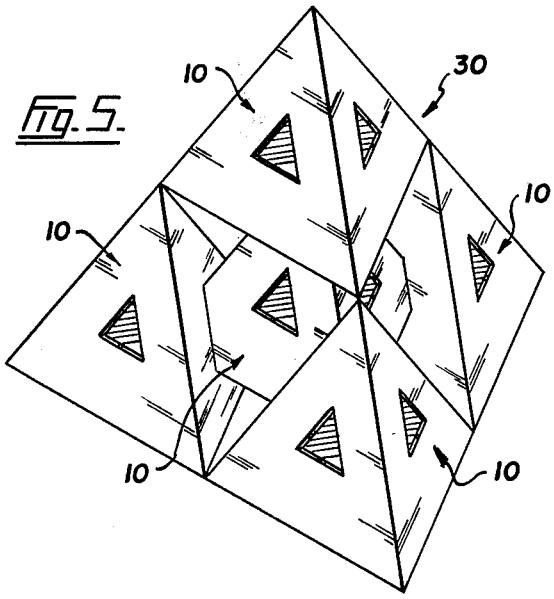
Figure 6:
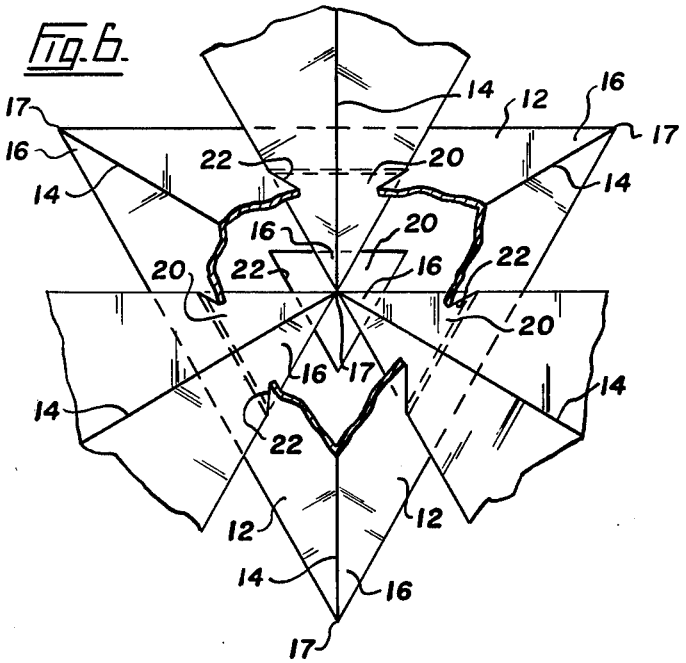
Figure 7:
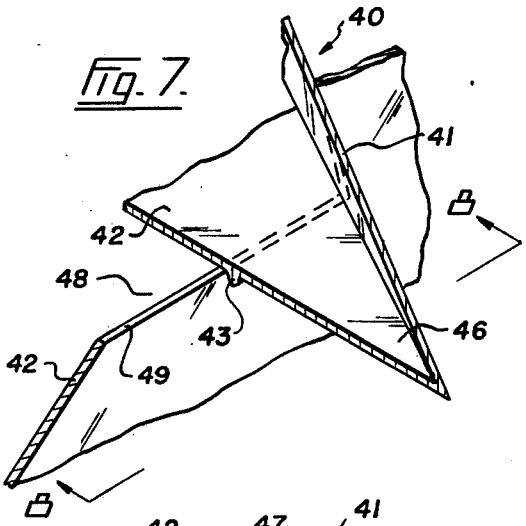
Figure 8:
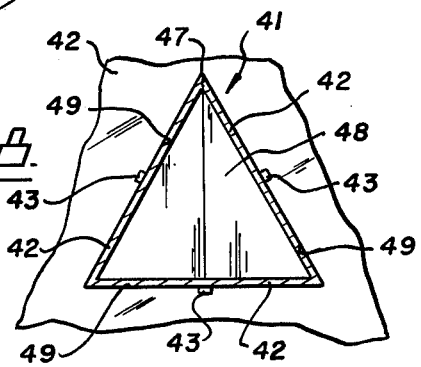

In drawings which illustrate preferred embodiments of the invention,

FIG. 1 is a plan view of a building block of the present invention,

FIG. 2 is a perspective view of the block as it would be seen as a vertical section, FIG. 3 is a side elevation of the block, FIG. 4 is a diagrammatic view of a wall of the block, FIG. 5 is a perspective view showing a typical structure built with the blocks, FIG. 6 is a plan view, part broken away, showing three such blocks interconnected by a fourth block, FIG. 7 is a perspective view with parts in section showing a modified block provided with retainer means, and FIG. 8 is a transverse section taken on the line 8—8 of FIG. 7.

Referring to the drawings, the numeral 10 indicates a block which forms the basic structural unit of the present invention. The block 10 comprises a hollow, regular tetrahedron body 11 which has four identically shaped walls 12. Each wall 12 is an equilateral triangle, that is, ridges 14 which are formed at the junctions of the walls are of equal length and the included angles formed by these ridges are each 60°. The ridges 14 extend between four corners 16 of the block 10 and these sharply-pointed corners, of course, are identically shaped three-sided cones which have apexes or tips 17.

The side walls 12 of the body are each provided with an opening 20. These openings have side edges 22 which also define equilateral triangles. The proportion and location of these openings 20 on the walls will be understood best with reference to diagrammatic FIG. 4.

Each wall 12, see FIG. 4, is an equilateral triangle designated by the letters A, B and C. Letters D, E and F represent the equilateral triangles formed by an opening 20 in the wall. All included angles shown, of course, are 60°. The exact center of the opening 20 is on the exact center of the wall 12. Put another way, lines 24, 25 and 26 which bisect all included angles intersect at a common center indicated at 27. The sides 22 of the opening are parallel to and equidistantly spaced from adjacent sides or ridges 14 of the wall. The distance between each side 22 and the adjacent side ridge 14 is one quarter the distance between that side and the tip of the corner 16 located directly opposite on the same bisecting line. In other words, the total area of a wall 12 is sixteen times as great as the corresponding area of the opening 20 therein.

The importance of the above-described relationship between the walls and their openings will be understood with reference to FIGS. 5 and 6. In FIG. 5, there is shown a simplified arrangement of the blocks 10. Five of the blocks are assembled to form a tetrahedral structure generally indicated at 30. Such a structure is constructed by placing three blocks side by side on a flat surface with a fourth block used as a connector. To act as a connector, the corners 16 of the fourth block are entered into openings 20 of the other three blocks whereupon a fifth block is placed on top of the fourth. A corner 16 of the fourth block projects upwardly through an opening 20 on the underside of the fifth block with three corners of the latter block resting on the tips of the three blocks originally placed on the flat surface. Thus, a tetrahedral structure 30 is constructed and as a static load-bearing arrangement of the blocks 10, the structure having inherent stability and resistance to separation. It should be noted that other blocks 10 can be added to extend the simplified structure either vertically or horizontally, or in both directions, whereby to produce a variety of differently shaped structural units.

Referring now to FIG. 6, this view provides a further illustration of the importance of the related sizes of the openings and the block walls. The corners 16 of three blocks are shown projecting into the openings 20 of a fourth block. It will be noticed that the corners 16 are a close fit within the openings 20 so that said corners can project only a limited distance into the fourth block. This distance is such that the tips 17 of the corners meet exactly at the center of the fourth block. By joining the blocks together in this manner, most structures built using the blocks are quite steady and there is no tendency of the blocks to separate under vertically imposed loads.

The above described blocks are suitable for the construction of load-bearing as well as other structures which do not require that the interlocking blocks be secured in any way, one to the other, but when the blocks are to be used as a toy rather than as a full-scale building unit likely to be subjected to unusual stresses and so on, I propose to modify the block slightly as shown in FIGS. 7 and 8. In these two views, the numeral 40 indicates generally a block having a tetrahedron body 41. This body has the same shape and arrangement of parts as the previously described body but, in addition, each wall 42 is provided with a retainer knob 43. Preferably, the knob 43 are integrally formed with the walls which are quite thin and therefore slightly flexible. The knobs 43 project outwardly from the outer faces of the wall and are located on corners 46 thereof and centered between adjoining ridges 47 of the body.

When a corner 46 of such a block is pushed into an opening 48 of another block, the walls 42 flex slightly to allow the knobs 43 to ride over side edges 49 of the opening and arrive at the position shown in FIGS. 7 and 8. The knobs 43 then serve as retaining means which offer resistance to withdrawal of the corners from the openings. This interlocking action is sufficient to prevent collapse of an assembly of blocks should it receive a bump from a child at play, for example, but the blocks of the assembly are otherwise quite easily separated by a slight tug applied in the normal direction of withdrawal.

From the foregoing, it will be apparent I have provided quite simple building blocks which are capable of being assembled into any number of relatively complex structural units. The blocks preferably are hollow as described for lightness and ease of handling but, particularly in the case of the preferred embodiment, the blocks may also be made as solid structures with the opening then being substantially cone-shaped recesses meeting at the vertical axis of a block. It will be noticed the corners and the openings form a spigot and socket type joint which effectively connects one block to another for most structural units. When the assembled blocks must be interlocked in a more positive manner, the slightly modified blocks shown in FIGS. 7 and 8 are used with the retaining means then resisting withdrawal of the corners from the openings.

I claim:

1. A building block adapted to be assembled with other such blocks to form a structural unit, each of said blocks comprising a hollow tetrahedron body having four identical side walls shaped as equilateral triangles, said side walls being interconnected along ridges which terminate at tips of substantially conical corners, each of the side walls having a central opening provided with side edges, said side edges of each opening defining an equilateral triangle and being equidistantly spaced from and disposed parallel to adjacent ridges, said corners each being enterable into an opening of an adjoining body to abut the side edges thereof, the relative sizes of the openings and the corners are such that the tip of a corner lodged in an opening of a vertically standing body is disposed at the vertical axis of said body.

2. A building block as claimed in claim 1, in which the ratio between the area of each of said openings and the area of each of said walls is 1 to 16.

3. A building block as claimed in claim 1, and including retaining means on at least one wall near each corner adapted to resist withdrawal of said corner from an opening in a wall of an adjoining body.

4. A modular system as claimed in claim 3, in which said retaining means comprises a knob projecting from an outer surface of said one wall.

5. A modular system as claimed in claim 1, and including a retainer knob projecting from an outer surface of each wall near each tip in a position to engage a side edge of an opening when a corner of an adjoining body is lodged therein.

* * * * *